US011837178B2

(12) United States Patent
Kim

(10) Patent No.: US 11,837,178 B2
(45) Date of Patent: Dec. 5, 2023

(54) DISPLAY DEVICE AND DRIVING METHOD THEREOF

(71) Applicant: LG Display Co., Ltd., Seoul (KR)

(72) Inventor: JungHoon Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 18/084,250

(22) Filed: Dec. 19, 2022

(65) Prior Publication Data

US 2023/0206864 A1 Jun. 29, 2023

(30) Foreign Application Priority Data

Dec. 23, 2021 (KR) ..... 10-2021-0186013

(51) Int. Cl.
*G09G 3/3291* (2016.01)

(52) U.S. Cl.
CPC ... *G09G 3/3291* (2013.01); *G09G 2300/0842* (2013.01); *G09G 2310/027* (2013.01); *G09G 2310/08* (2013.01); *G09G 2320/029* (2013.01); *G09G 2320/0693* (2013.01); *G09G 2360/16* (2013.01)

(58) Field of Classification Search
CPC ..... G09G 3/3291; G09G 2300/0842; G09G 2310/027; G09G 2310/08; G09G 2320/029; G09G 2320/0693; G09G 2360/16; G09G 2320/0295; G09G 2320/045; G09G 3/3275; G09G 3/3233; G09G 3/3225; G09G 2300/043; G09G 2320/0271
See application file for complete search history.

(56) References Cited

U.S. PATENT DOCUMENTS

2016/0189625 A1* 6/2016 Kim ..... G09G 3/3233 345/205
2018/0254004 A1* 9/2018 Hsiao ..... G09G 3/20
2019/0325822 A1* 10/2019 Li ..... G09G 3/3233
2020/0043421 A1 2/2020 Kang et al.
2020/0074939 A1 3/2020 Kim et al.
(Continued)

FOREIGN PATENT DOCUMENTS

KR 10-2135926 B1 7/2020

OTHER PUBLICATIONS

Extended European Search Report dated May 2, 2023, issued in corresponding European Patent Application No. 22215583.0.

*Primary Examiner* — Andrew Sasinowski
(74) *Attorney, Agent, or Firm* — Morgan, Lewis & Bockius LLP

(57) ABSTRACT

A display device may include: a display panel including a plurality of pixels, the display panel being configured to be driven in a first driving period, a blank period, and a second driving period; a data driver configured to provide a data voltage to at least one of the pixels to display an image based on a compensated image data, and detect a sensing voltage from a reference voltage line connected to the at least one of the pixels to convert the sensing voltage into a sensing data during the first driving period and the second driving period; and a timing controller configured to determine a first compensation data based on a difference between the sensing data detected during the first driving period and the sensing data detected during the second driving period, and determine the compensated image data based on an input image data and the first compensation data.

20 Claims, 9 Drawing Sheets

(56) References Cited

U.S. PATENT DOCUMENTS

| | | | | |
|---|---|---|---|---|
| 2020/0160781 | A1 | 5/2020 | Park | |
| 2020/0372861 | A1* | 11/2020 | Ok | G09G 3/3233 |
| 2021/0104195 | A1 | 4/2021 | Choi et al. | |

* cited by examiner

DISPLAY DEVICE AND DRIVING METHOD THEREOF

CROSS-REFERENCE TO RELATED APPLICATION

This application claims the priority of Korean Patent Application No. 10-2021-0186013 filed on Dec. 23, 2021, in the Korean Intellectual Property Office, the disclosure of which is incorporated herein by reference.

BACKGROUND

1. Technical Field

The present disclosure relates to a display device and a driving method thereof, and more particularly, to a display device configured to compensate for data more accurately and a driving method thereof.

2. Description of the Related Art

Among devices used for a monitor of a computer, a television, a cellular phone, or other electronic devices are an organic light emitting display (OLED) device, which is a self-emitting device, and a liquid crystal display (LCD) device, which requires a separate light source.

Among various display devices, an OLED device includes a display panel including a plurality of sub pixels and a driver which drives the display panel. The driver may include a gate driver for supplying a gate signal and a data driver for supplying a data voltage to the display panel. When a signal, such as a gate signal and a data voltage, is supplied to a sub pixel of the OLED device, the selected sub pixel emits light to display images.

In recent years, a real-time compensation technique is applied to a blank period to improve an image quality. During the blank period, an OLED element does not emit light temporally for sensing so that a recovery voltage may be applied after the blank period to allow the OLED element to emit light.

In this case, a potential deviation of an OLED element emission voltage may occur before and after the blank period, thereby causing a luminance difference to be generated. Therefore, there is a problem in that bright or dark lines may be recognized in an image screen so that the image quality may be deteriorated.

SUMMARY

Accordingly, embodiments of the present disclosure are directed to a display device and a driving method thereof that substantially obviate one or more problems due to the limitations and disadvantages of the related art.

An object of the present disclosure includes providing a display device capable of providing a uniform image quality before and after real-time compensation.

Another object of the present disclosure includes providing a display device capable of simultaneously compensating for both a characteristic value of a driving transistor and a data voltage offset.

The features and aspects of the present disclosure are not limited to those mentioned above. Additional features and aspects will be set forth in part in the description that follows and in part will become apparent to those skilled in the art from the description or may be learned by practice of the inventive concepts provided herein. Other features and aspects of the inventive concepts may be realized and attained by the structure particularly pointed out in, or derivable from, the written description, the claims hereof, and the appended drawings.

To achieve these and other advantages and in accordance with the purpose of the disclosure, as embodied and broadly described herein, a display device may include: a display panel including a plurality of pixels, the display panel being configured to be driven in a first driving period, a blank period after the first driving period, and a second driving period after the blank period; a data driver configured to provide a data voltage to at least one of the pixels to display an image based on a compensated image data, and detect a sensing voltage from a reference voltage line connected to the at least one of the pixels to convert the sensing voltage into a sensing data during the first driving period and the second driving period; and a timing controller configured to determine a first compensation data based on a difference between the sensing data detected during the first driving period and the sensing data detected during the second driving period, and determine the compensated image data based on an input image data and the first compensation data.

According to another aspect of the present disclosure, a method of driving a display device, comprising a display panel including a plurality of pixels and a data driver configured to provide a data voltage to at least one of the pixels, the display panel being configured to be driven in a first driving period and a second driving period to display an image and in a blank period between the first driving period and the second driving period, may include: detecting a first sensing voltage on a reference voltage line connected to the at least one of the pixels and determining the first sensing data based on the first sensing voltage during the first driving period; detecting a second sensing voltage on the reference voltage line and determining the second sensing data based on the second sensing voltage during the blank period; detecting a third sensing voltage on the reference voltage line and determining the third sensing data based on the third sensing voltage during the second driving period; determining a compensated image data based on at least one of the first, second, and third sensing data; and applying the data voltage to the at least one of the pixels based on the compensated image data.

According to example embodiments of the present disclosure, the displayed images before and after a blank period in which the sensing is conducted can be the same.

According to example embodiments of the present disclosure, the image quality deterioration due to the sensing can be suppressed.

It is to be understood that both the foregoing general description and the following detailed description of the present disclosure are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION

Figure 1:
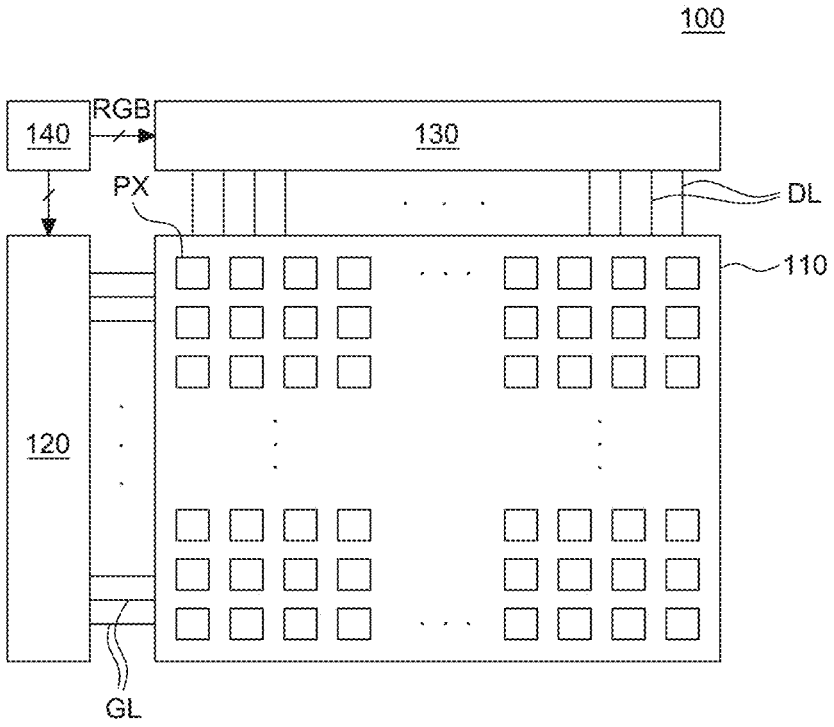
FIG. 1 is a schematic view of a display device according to an example embodiment of the present disclosure.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the protected scope of the present disclosure is defined by claims and their equivalents.

The shapes, sizes, ratios, angles, numbers, and the like, which are illustrated in the drawings to describe various example embodiments of the present disclosure, are merely given by way of example. Therefore, the present disclosure is not limited to the illustrations in the drawings. Like reference numerals generally denote like elements throughout the specification, unless otherwise specified.

In the following description, where the detailed description of the relevant known function or configuration may unnecessarily obscure an important point of the present disclosure, a detailed description of such known function of configuration may be omitted.

Where the terms "comprise," "have," "include," and the like are used, one or more other elements may be added unless the term, such as "only," is used. An element described in the singular form is intended to include a plurality of elements, and vice versa, unless the context clearly indicates otherwise.

In construing an element, the element is to be construed as including an error or tolerance range even where no explicit description of such an error or tolerance range is provided.

Where positional relationships are described, for example, where the positional relationship between two parts is described using "on," "over," "under," "above," "below," "beside," "next," or the like, one or more other parts may be located between the two parts unless a more limiting term, such as "immediate(ly)," "direct(ly)," or "close(ly)" is used. For example, where an element or layer is disposed "on" another element or layer, a third layer or element may be interposed therebetween.

Where an element or layer is referred to as being "on" or "connected to" another element or layer, it should be understood to mean that the element or layer may be directly on or directly connected to the other element or layer, or that intervening elements or layers may be present. Also, where one element is referred to as being disposed "on" or "under" another element, it should be understood to mean that the elements may be so disposed to directly contact each other, or may be so disposed without directly contacting each other.

Although the terms "first," "second," A, B, (a), (b), and the like may be used herein to describe various elements, these elements should not be interpreted to be limited by these terms as they are not used to define a particular order or precedence. These terms are used only to distinguish one element from another. For example, a first element could be termed a second element, and, similarly, a second element could be termed a first element, without departing from the scope of the present disclosure.

A size and a thickness of each component illustrated in the drawing are illustrated for convenience of description, and the present disclosure is not limited to the illustrated size and the thickness of the component.

Features of various embodiments of the present disclosure may be partially or entirely coupled to or combined with each other. They may be linked and operated technically in various ways as those skilled in the art can sufficiently understand. The embodiments may be carried out independently of or in association with each other in various combinations.

A transistor used for a display device according to embodiments of the present disclosure may be implemented with an n-channel transistor (NMOS) or a p-channel transistor (PMOS). The transistor may be implemented with an oxide semiconductor transistor having an oxide semiconductor as an active layer or a low temperature poly-silicon (LTPS) transistor having an LTPS as an active layer. The transistor may include at least a gate electrode, a source electrode, and a drain electrode. The transistor may be implemented by a thin film transistor (TFT) on a display panel. In the transistor, carriers may flow from the source electrode to the drain electrode. In the case of the n-channel transistor (NMOS), since the carriers are electrons, to allow the electrons to flow from the source electrode to the drain electrode, a source voltage is lower than a drain voltage. A direction of the current in the n-channel transistor (NMOS) may be from the drain electrode to the source electrode and the source electrode may serve as an output terminal. In the case of the p-channel transistor (PMOS), since the carriers are holes, to allow the holes to flow from the source electrode to the drain electrode, a source voltage is higher than a drain voltage. In the p-channel transistor (PMOS), the holes may flow from the source electrode to the drain electrode so that current flows from the source to the drain and the drain electrode may serve as an output terminal. Accordingly, the source and the drain may be switched in accordance with the applied voltage so that it should be noted that the source and the drain of the transistor are not fixed. In the following description, the transistor is assumed to be a n-channel transistor (NMOS), but the present disclosure is not limited thereto. The p-channel transistor may be used instead, and thus a circuit configuration may be changed accordingly.

A gate signal of transistors used as switching elements may swing between a turn-on voltage and a turn-off voltage. The turn-on voltage may be set to be higher than a threshold voltage Vth of the transistor, and the turn-off voltage may be set to be lower than the threshold voltage Vth of the transistor. The transistor may be turned on in response to the turn-on voltage and be turned off in response to the turn-off voltage. In the case of the NMOS, the turn-on voltage may be a high voltage, and the turn-off voltage may be a low voltage. In the case of the PMOS, the turn-on voltage may be a low voltage, and the turn-off voltage may be a high voltage.

Reference will now be made in detail to embodiments of the present disclosure, examples of which may be illustrated in the accompanying drawings.

FIG. 1 is a schematic view of a display device according to an example embodiment of the present disclosure.

As illustrated in FIG. 1, a display device 100 may include a display panel 110, a gate driver 120, a data driver 130, and a timing controller 140.

The display panel 110 may be a panel for displaying images. The display panel 110 may include various circuits, wiring lines, and light emitting diodes disposed on a substrate. The display panel 110 may be divided into a plurality of data lines DL and a plurality of gate lines GL intersecting each other and may include a plurality of pixels PX connected to the plurality of data lines DL and the plurality of gate lines GL, respectively. The display panel 110 may include a display area defined by a plurality of pixels PX and a non-display area in which various signal lines or pads may be formed. The display panel 110 may be implemented by a display panel 110 used in various display devices, such as an LCD device, an OLED device, or an electrophoretic display device. In example embodiments described below, the display panel 110 is described as a panel used in the OLED device, but the present disclosure is not limited thereto.

The timing controller 140 may receive timing signals, such as a vertical synchronization signal, a horizontal synchronization signal, a data enable signal, or a dot clock, by means of a receiving circuit, such as an LVDS or TMDS interface, connected to a host system. The timing controller 140 may generate a data control signal to control the data driver 130 and gate control signals to control the gate driver 120, based on the input timing signals.

The timing controller 140 may process the image data (RGB) input from an external source suitable for the size and resolution of the display panel 110 to convert the image data (RGB) and may supply the converted image data (RGB) to the data driver 130.

The timing controller 140 may sense a characteristic value (e.g., a mobility or a threshold voltage) of a driving transistor disposed in each of the plurality of pixels PX to generate compensation data for the characteristic value (e.g., a mobility or a threshold voltage) of the driving transistor. The timing controller 140 may compensate for image data RGB using the compensation data.

The data driver 130 may supply a data voltage Vdata to a plurality of sub pixels. The data driver 130 may include a source printed circuit board and a plurality of source driving integrated circuits. Each of the plurality of source driving integrated circuits may be supplied with image data RGB and a data control signal from the timing controller 140 by means of a source printed circuit board.

The data driver 130 may convert image data RGB into a gamma voltage in response to the data control signal to generate a data voltage Vdata and may supply the data voltage Vdata through the data lines DL of the display panel 110.

The data driver 130 may receive the sensing voltage from the plurality of pixels PX to convert the sensing voltage into sensing data for a characteristic value (e.g., a mobility or a threshold voltage) of the driving transistor. The sensing data may be output to the timing controller 140.

The plurality of source driving integrated circuits may be connected to the data lines DL of the display panel 100 in the form of chip on film (COF). To be more specific, each of the plurality of source driving integrated circuits may be implemented in a chip form disposed on a connection film, and wiring lines connected to the source driving integrated circuits in the form of a chip or chips may also be formed on the connection film. However, the placement of the plurality of source driving integrated circuits is not limited thereto and may be connected to the data lines DL of the display panel 110 by, for example, a chip on glass (COG) process or a tape automated bonding (TAB) process.

The gate driver 120 may supply a gate signal to the plurality of sub pixels. The gate driver 120 may include a level shifter and a shift register. The level shifter may shift a level of a clock signal input at a transistor-transistor-logic (TTL) level from the timing controller 140 and then may supply the clock signal to the shift register. The shift register may be formed in the non-display area of the display panel 110, by a GIP manner, but is not limited thereto. The shift register may include a plurality of stages which shifts the gate signal to output, in response to the clock signal and the driving signal. The plurality of stages included in the shift register may sequentially output the gate signal through a plurality of output terminals.

The display panel 110 may include a plurality of sub pixels. The plurality of sub pixels may emit light of different colors. For example, the plurality of sub pixels may include a red sub pixel, a green sub pixel, a blue sub pixel, and a white sub pixel, but is not limited thereto. The plurality of sub pixels may configure a pixel PX. That is, the red sub pixel, the green sub pixel, the blue sub pixel, and the white sub pixel may configure one pixel PX, and the display panel 110 may include a plurality of pixels PX. For ease of reference, a sub pixel is referred to as a pixel or pixel PX in the below description.

Hereinafter, an example driving circuit for driving one pixel (or one sub pixel) will be described in more detail with reference to FIG. 2.

Figure 2:
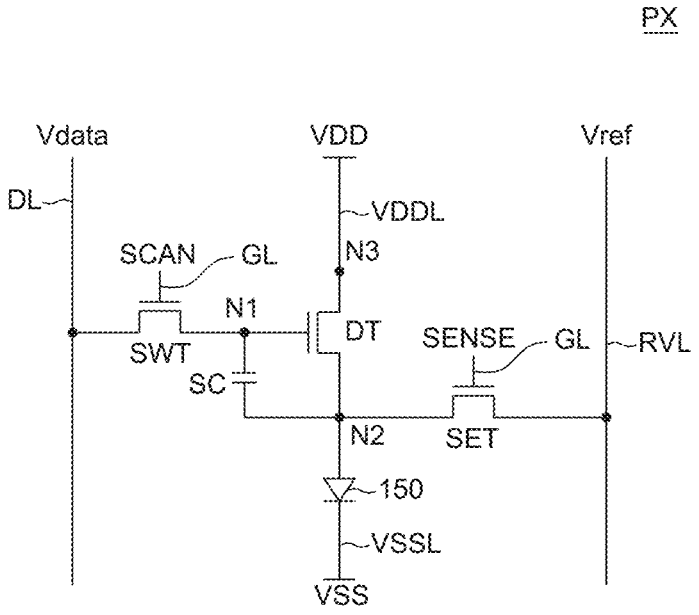
FIG. 2 is a circuit diagram of a sub pixel of a display device according to an example embodiment of the present disclosure.

FIG. 2 is a circuit diagram of a pixel of a display device according to an example embodiment of the present disclosure.

FIG. 2 illustrates a circuit diagram for one pixel among a plurality of pixels of the display device 100.

As shown in FIG. 2, the pixel may include a switching transistor SWT, a sensing transistor SET, a driving transistor DT, a storage capacitor SC, and a light emitting diode 150.

The light emitting diode 150 may include an anode, an organic layer, and a cathode. The organic layer may include various organic layers, such as a hole injection layer, a hole transport layer, an organic light emitting layer, an electron transport layer, and an electron injection layer. The anode of the light emitting diode 150 may be connected to an output terminal of the driving transistor DT, and a low potential voltage VSS may be applied to the cathode through the low potential voltage line VSSL. The light emitting diode 150 in FIG. 2 is described here as an OLED 150, but the present disclosure is not limited thereto. For example, an inorganic light emitting diode, that is, an LED, may also be used as the light emitting diode 150.

The above-described low potential voltage line VSSL may be a positive voltage line configured to apply a positive low potential and may be denoted as a ground terminal.

As shown in FIG. 2, the switching transistor SWT may be a transistor which transmits the data voltage Vdata to a first node N1 corresponding to a gate electrode of the driving transistor DT. The switching transistor SWT may include a drain electrode connected to the data line DL, a gate electrode connected to the gate line GL, and a source electrode connected to the gate electrode of the driving transistor DT. The switching transistor SWT may be turned on by a scan signal SCAN applied from the gate line GL to transmit a data voltage Vdata supplied from the data line DL to the first node N1 corresponding to the gate electrode of the driving transistor DT.

As illustrated in FIG. 2, the driving transistor DT may be a transistor which supplies a driving current to the light emitting diode 150 to drive the light emitting diode 150. The driving transistor DT may include a gate electrode corresponding to a first node N1, a source electrode corresponding to a second node N2 and an output terminal, and a drain electrode corresponding to a third node N3 and an input terminal. The gate electrode of the driving transistor DT may be connected to the switching transistor SWT, the drain electrode may receive a high potential voltage VDD by means of a high potential voltage line VDDL, and the source electrode may be connected to the anode of the light emitting diode 150.

As shown in FIG. 2, the storage capacitor SC may be a capacitor which maintains a voltage corresponding to the data voltage Vdata for one frame. One electrode of the storage capacitor SC may be connected to the first node N1, and the other electrode may be connected to the second node N2.

In the case of the example display device 100, as the driving time of each pixel is increased, the circuit element such as the driving transistor DT may be degraded. Accordingly, a unique characteristic value of the circuit element, such as a driving transistor DT, may be changed. Here, the unique characteristic value of the circuit element may include a threshold voltage Vth of the driving transistor DT or a mobility a of the driving transistor DT. The change in the characteristic value of the circuit element may cause a luminance change of the corresponding pixel. Accordingly, the change in the characteristic value of the circuit element may be used as representing the luminance change of the pixel.

Further, the degree of change in the characteristic values between circuit elements of each pixel may vary depending on a degree of degradation of each circuit element. Such a difference in the degree of change in the characteristic values between the circuit elements may cause a luminance deviation between the pixels. Accordingly, the characteristic value deviation between circuit elements may be used as representing the luminance deviation between the pixels. The change in the characteristic values of the circuit elements, that is, the luminance change of the pixel and the characteristic value deviation between the circuit elements, that is, the luminance deviation between the pixels, may cause problems, such as lowering of the accuracy for luminance expressiveness of the pixels or screen abnormality.

Therefore, the pixel of the display device 100 according to an example embodiment of the present disclosure may provide a sensing function of sensing a characteristic value for the pixel and a compensating function of compensating for the characteristic value of the pixel using the sensing result.

Therefore, as illustrated in FIG. 2, the pixel may further include a sensing transistor SET to effectively control a voltage state of the source electrode of the driving transistor DT, in addition to the switching transistor SWT, the driving transistor DT, the storage capacitor SC, and the light emitting diode 150.

As illustrated in FIG. 2, the sensing transistor SET may be connected between the source electrode of the driving transistor DT and the reference voltage line RVL supplying a reference voltage Vref, and a gate electrode may be connected to the gate line GL. Therefore, the sensing transistor SET may be turned on by the sensing signal SENSE applied through the gate line GL to apply the reference voltage Vref supplied through the reference voltage line RVL to the source electrode of the driving transistor DT. Further, the sensing transistor SET may be utilized as one of voltage sensing paths for the source electrode of the driving transistor DT.

As shown in FIG. 2, the switching transistor SWT and the sensing transistor SET of the pixel may share one gate line GL. That is, the switching transistor SWT and the sensing transistor SET may be connected to the same gate line GL to be applied with the same gate signal. For the convenience of description, a voltage applied to the gate electrode of the switching transistor SWT may be referred to as a scan signal SCAN, and a voltage applied to the gate electrode of the sensing transistor SET may be referred to as a sensing signal SENSE. However, the scan signal SCAN and the sensing signal SENSE applied to one pixel may be the same signal which is transmitted from the same gate line GL.

However, the present disclosure is not limited thereto. For example, only the switching transistor SWT may be connected to the gate line GL, and the sensing transistor SET may be connected to a separate sensing line. Therefore, the scan signal SCAN may be applied to the switching transistor SWT through the gate line GL, and the sensing signal SENSE may be applied to the sensing transistor SET through a separate sensing line.

Accordingly, the reference voltage Vref may be applied to the source electrode of the driving transistor DT by means of the sensing transistor SET. Further, the threshold voltage Vth of the driving transistor DT or a sensing voltage for sensing the mobility a of the driving transistor DT may be detected through the reference voltage line RVL. Further, the data driver 130 may compensate for the data voltage Vdata in accordance with a variation of the threshold voltage Vth of the driving transistor DT or the mobility a of the driving transistor DT.

Figure 3:
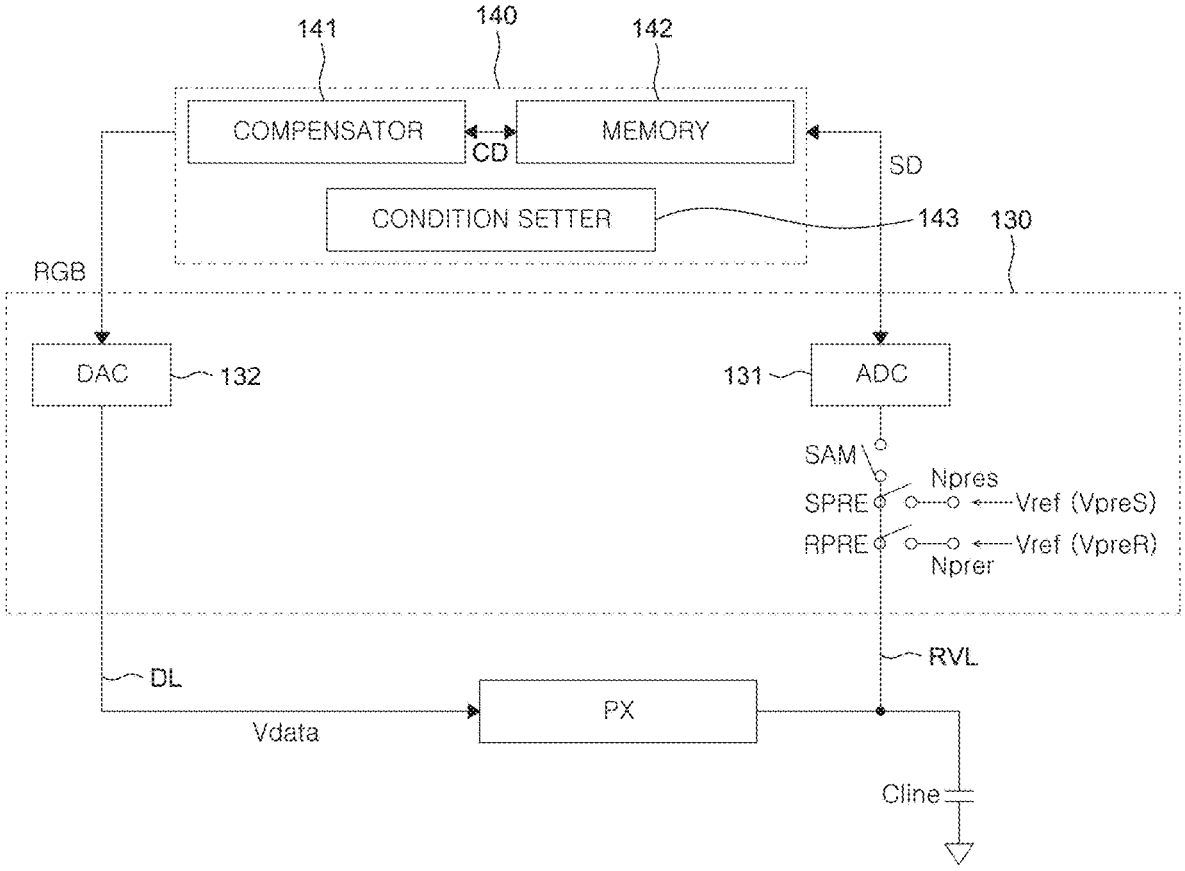
FIG. 3 is a block diagram illustrating a timing controller and a data driver for compensation of a display device according to an example embodiment of the present disclosure.

FIG. 3 is a block diagram illustrating a timing controller and a data driver for compensation of a display device according to an example embodiment of the present disclosure.

As described above, the display device 100 according to an example embodiment of the present disclosure may determine a characteristic value or a change in the characteristic value of a driving transistor DT in the pixel PX from the sensing voltage of the reference voltage line RVL during the sensing period. Therefore, the reference voltage line RVL may serve not only to transmit the reference voltage Vref but may also serve as a sensing line for sensing a characteristic value of the driving transistor DT in the pixel PX. Accordingly, the reference voltage line RVL may also be referred to as a sensing line.

Specifically, as illustrated in FIGS. 2 and 3, during the sensing period of the display device 100 according to an example embodiment of the present disclosure, the characteristic value or the change in the characteristic value of the driving transistor DT may be reflected as a voltage (for example, Vdata−Vth) at the second node N2, e.g., the source electrode of the driving transistor DT.

When the sensing transistor SET is turned on, the voltage at the second node N2 (e.g., the source node of the driving transistor DT) may correspond to a sensing voltage on the reference voltage line RVL. Further, the line capacitor Cline on the reference voltage line RVL may be charged by the voltage at the second node N2 of the driving transistor DT, and the reference voltage line RVL may have a sensing voltage corresponding to a voltage at the second node N2 of the driving transistor DT by the charged line capacitor Cline.

The display device 100 according to an example embodiment of the present disclosure may control the switching transistor SWT and the sensing transistor SET the pixel PX to be turned on/off and may control the supplying of the data voltage Vdata and the reference voltage Vref, respectively. Therefore, the second node N2 of the driving transistor DT may be driven to be in a voltage state to reflect the characteristic value (a threshold voltage or a mobility) or a change in the characteristic value of the driving transistor DT.

The data driver 130 of the display device 100 according to an example embodiment of the present disclosure may include an analog-to-digital converter ADC 131 and switch circuits SAM and SPRE. The analog-to-digital converter ADC 131 may measure a sensing voltage on the reference voltage line RVL corresponding to a voltage at the second node N2 of the driving transistor DT and may convert the sensing voltage into a digital value. The switch circuits SAM and SPRE may sense the characteristic value.

The data driver 130 may include a digital-to-analog converter DAC 132 configured to convert the image data RGB into an analog gamma voltage to output a data voltage Vdata and a switch RPRE for image driving. In addition, the data driver 130 may further include a latch circuit and buffer circuits for processing image data RGB.

The data driver may further include an ADC 131 and various switches SAM, SPRE, and RPRE. Alternatively, the ADC 131 and various switches SAM, SPRE, and RPRE may be provided external to the data driver 130.

The switch circuits SAM and SPRE to control the sensing driving may include a sensing reference switch SPRE and a sampling switch SAM. The sensing reference switch SPRE may control the connection between each reference voltage line RVL and a sensing reference voltage supply node Npres to which the reference voltage Vref may be supplied. The sampling switch SAM may control the connection between each reference voltage line RVL and the ADC 131.

Here, the sensing reference switch SPRE is a switch which may control the sensing driving. The reference voltage Vref supplied to the reference voltage line RVL by the sensing reference switch SPRE may be a sensing reference voltage VpreS.

The image driving reference switch RPRE may control a connection between each reference voltage line RVL and an image driving reference voltage supplying node Nprer to which the reference voltage Vref may be supplied. The image driving reference switch RPRE may be a switch used for image driving. The reference voltage Vref supplied to the reference voltage line RVL by the image driving reference switch RPRE may correspond to an image driving reference voltage VpreR.

That is, the sensing reference switch SPRE, which may be a first voltage switch, may apply the sensing reference voltage VpreS to the reference voltage line RVL. The image driving reference switch RPRE, which may be a second voltage switch, may apply the image driving reference voltage VpreR to the reference voltage line RVL.

Here, the sensing reference switch SPRE and the image driving reference switch RPRE may be separately provided or may be implemented to be integrated as one. The sensing reference voltage VpreS and the image driving reference voltage VpreR may be the same voltage value or different voltage values.

The timing controller 140 may include a data compensator 141 configured to compensate data (i.e., determine compensation data CD), a memory 142 configured to store data for a long time or a short time, and a condition setter 143.

The memory 142 may store sensing data SD output from the ADC 131 or may store compensation data CD output from the data compensator 141.

The data compensator 141 may calculate new compensation data CD to compensate for a deviation in the characteristic value by comparing the sensing data SD and the compensation data CD stored in the memory 42. The new compensation data CD calculated by the data compensator 141 may then be stored in the memory 142.

The timing controller 140 may compensate for a digital signal type of image data RGB to be supplied to the data driver 130 using compensation data CD stored in the memory 142.

The compensated image data RGB may be output to the data driver 130. Accordingly, the DAC 132 in the data driver 130 may convert image data RGB compensated by the data compensator 141 into an analog signal type of data voltage Vdata. After the sensing process for all lines are completed, the compensated data voltage Vdata may be output to the corresponding data lines DL through an output buffer. As a result, the characteristic value deviation (a threshold voltage deviation or a mobility deviation) for the driving transistor DT in the corresponding pixel PX may be compensated for.

Further, the data compensator 141 may be disposed external to the timing controller 140 or may be included in the timing controller 140. The memory 142 may be disposed external to the timing controller 140 or may be implemented in a register form in the timing controller 140.

Figure 4:
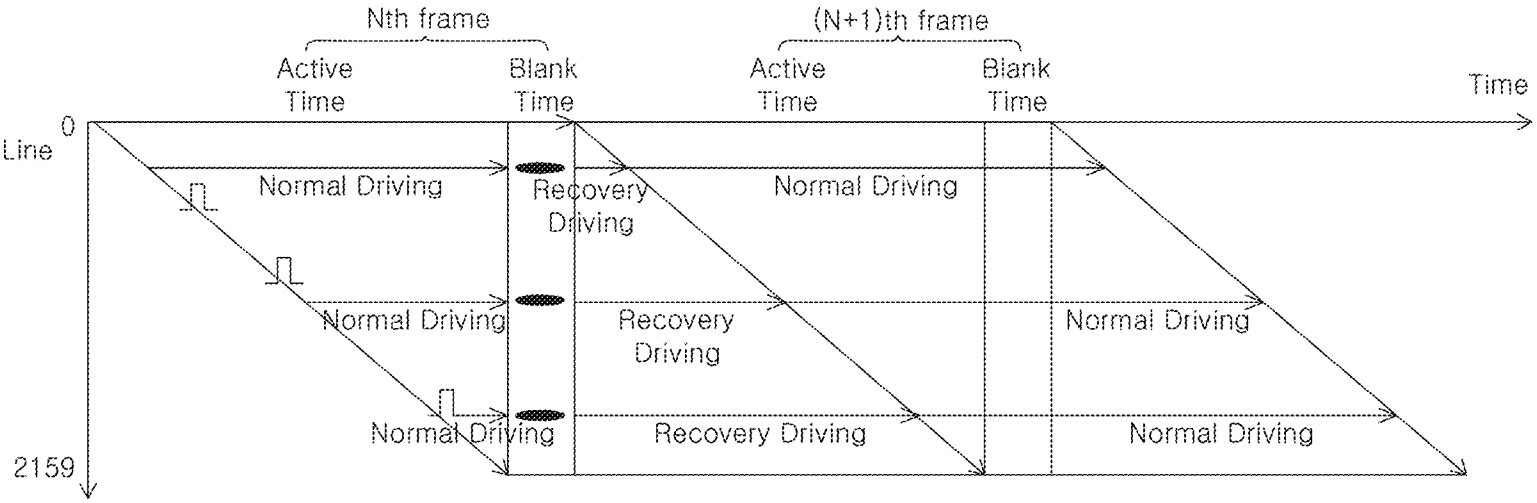
FIG. 4 is a graph for explaining an operation of a display device for every frame according to an example embodiment of the present disclosure.

FIG. 4 is a graph for explaining an operation of a display device for every frame according to an example embodiment of the present disclosure.

As illustrated in FIG. 4, during the driving period (Active Time) of a N-th frame, a data voltage Vdata for image driving may be sequentially written in pixels PX respectively through a plurality of lines so that the plurality of pixels PX may emit light (normal driving).

Next, during a blank period (Blank Time) of the N-th frame, a process of sensing a characteristic value deviation for a driving transistor disposed in a plurality of pixels PX in a specific line or lines may be performed. At this time, a sensing data voltage Vdata may be applied to the plurality of pixels in a specific line or lines. The plurality of pixels PX may be driven in the sensing process so that the plurality of pixels does not emit light.

Next, during the driving period (Active Time) of the (N+1)-th frame, a data voltage Vdata for recovery driving may be written in a plurality of pixels PX in the specific line or lines in which the sensing process was performed during the blank period (Blank Time) of the N-th frame so that the plurality of pixels PX may emit light (recovery driving). The data voltage Vdata for recovery driving may be equal to a data voltage Vdata for image driving.

That is, the driving period (Active Time) may be divided into a first driving period in which a data voltage Vdata for image driving is applied to the plurality of pixels PX before the blank period (Blank Time) and a second driving period in which the recovery data voltage Vdata is applied to the plurality of pixels PX after the blank period (Blank Time). Accordingly, a data voltage Vdata for normal driving applied during the first driving period may be denoted as a first image data voltage Vdata, and a data voltage Vdata for recovery driving applied during the second driving period may be denoted as a second image data voltage Vdata.

Further, during a driving period (Active Time) of a (N+1)-th frame, an image data voltage Vdata which is compensated to reflect the sensing process may be sequentially written in the pixels PX in a plurality of lines so that the plurality of pixels PX may emit light (normal driving).

Hereinafter, operations during a first driving period, a blank period, and a second driving period according to an example embodiment of the present disclosure will be described with reference to FIGS. 5 to 7.

Figure 5:
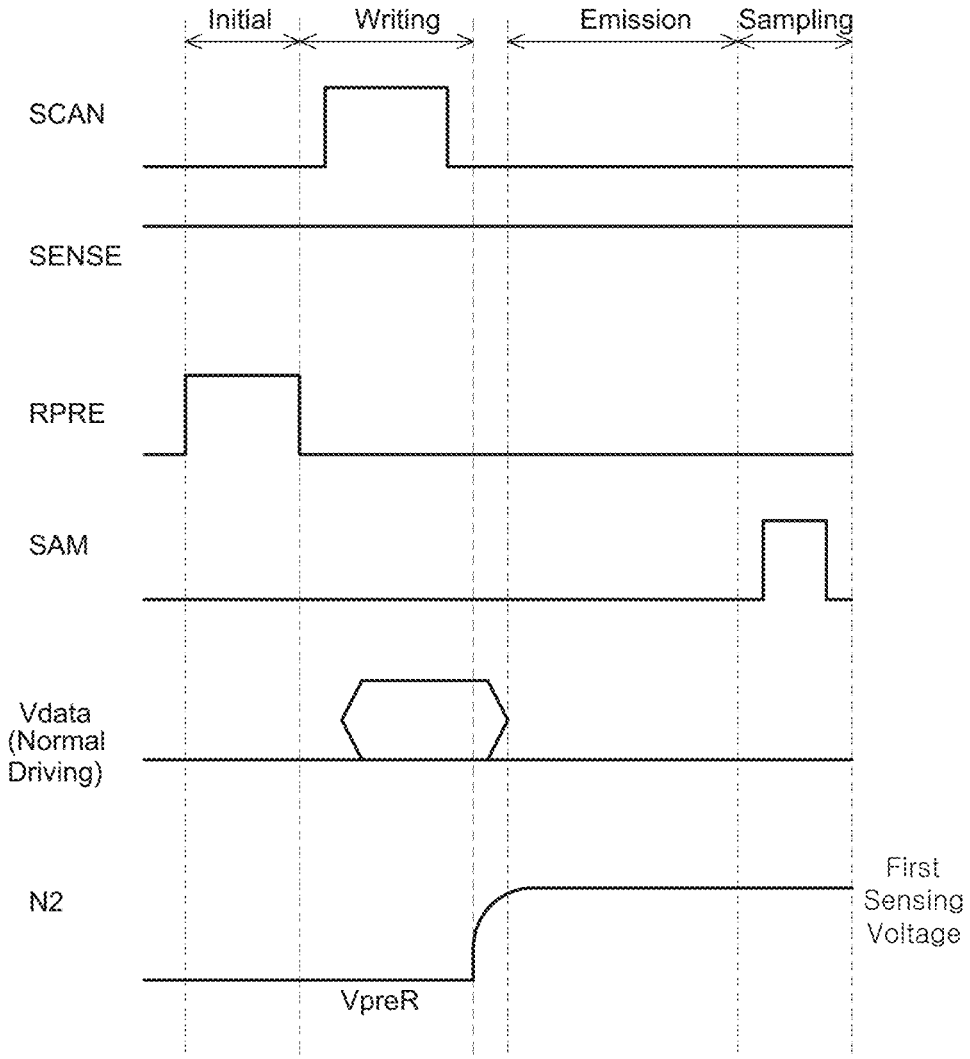
FIG. 5 is a timing chart of a signal for normal driving during a first driving period of a display device according to an example embodiment of the present disclosure.

FIG. 5 is a timing chart of a signal for normal driving during a first driving period of a display device according to an example embodiment of the present disclosure.

As shown in FIGS. 2, 3, and 5, in the display device according to an example embodiment of the present disclosure, during the first driving period, an initialization step, a writing step, an emission step, and a sampling step may be performed. Generally, a second node N2 (e.g., a source electrode of the driving transistor DT) or a voltage at the second node N2 may be sensed by individually turning on or turning off the switching transistor SWT and the sensing transistor SET. Therefore, unlike the example configuration illustrated in FIG. 2, the sensing operation may be performed with an example structure in which the scan signal SCAN and the sensing signal SENSE may be separately applied to the switching transistor SWT and the sensing transistor SET, respectively, by means of two separate gate lines GL.

During the initialization step, the sensing transistor SET may be turned on, and the driving reference switch RPRE may be turned on, by a sensing signal SENSE at a turn-on level. In this state, the second node N2 (e.g., the source electrode) of the driving transistor DT may be initialized to a driving reference voltage VpreR.

During the writing step, the switching transistor SWT may be turned on, and a first image data voltage Vdata for normal driving may be written in the first node N1 of the driving transistor DT, by the scan signal SCAN at a turn-on level.

During the emission step, a voltage corresponding to a difference between the first image data voltage Vdata (normal driving) and the threshold voltage may be charged in the second node N2 according to the first image data voltage Vdata (normal driving) written in the first node N1. Further, a driving current flowing in the light emitting diode 150 may be determined according to the voltage at the second node N2 so that the light emitting diode 150 may emit light.

During the sampling step, the sampling switch SAM may be turned on. At this time, the ADC 131 may sense the first sensing voltage of the reference voltage line RVL connected by the sampling switch SAM and may convert the first sensing voltage, which is an analog signal, into first sensing data, which is a digital signal. Here, the first sensing voltage applied to the ADC 131 may be a voltage at the second node N2 which is saturated during the first driving period.

That is, during the first driving period, when the reference switch RPRE for image driving (i.e., a second voltage switch) is in an off state, the reference switch SPRE for sensing (i.e., a first voltage switch) is switched from the on-state to an off-state, and the sampling switch SAM is in an on state, the first sensing voltage may be sampled.

Figure 6:
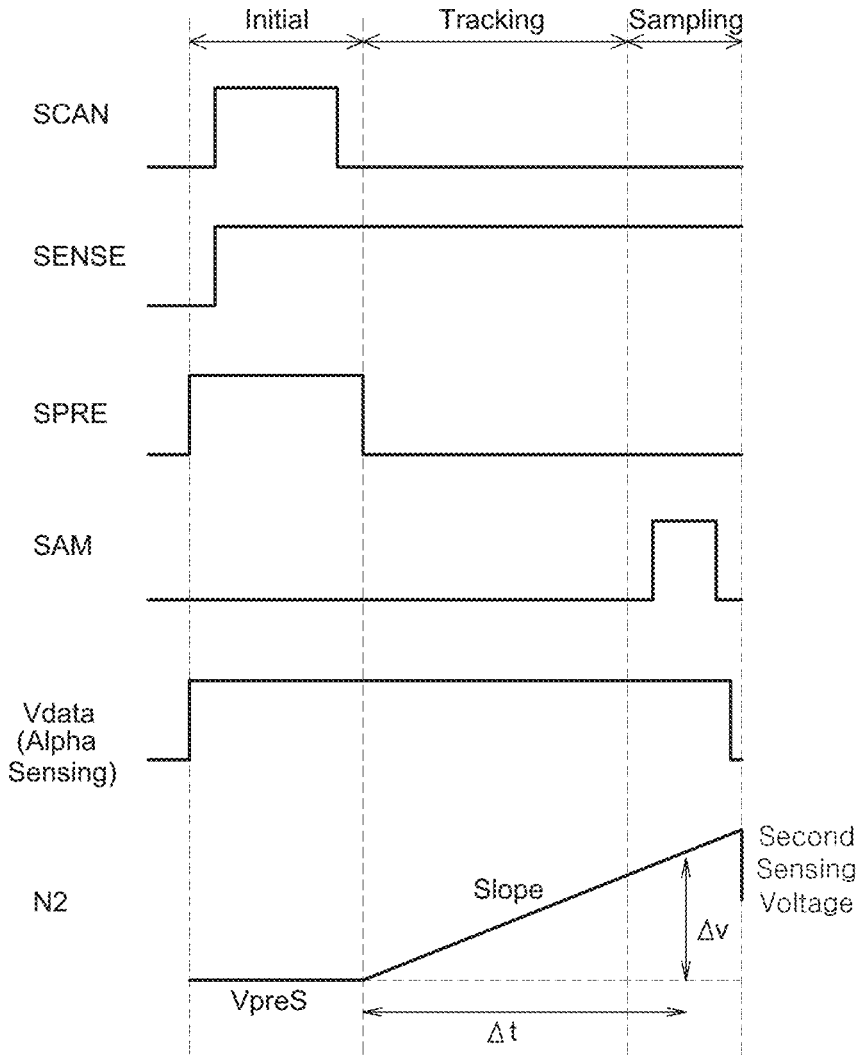
FIG. 6 is a timing chart of a signal for sensing a mobility during a blank period of a display device according to an example embodiment of the present disclosure.

FIG. 6 is a timing chart of a signal for sensing a mobility during a blank period of a display device according to an example embodiment of the present disclosure.

As shown in FIG. 6, the mobility sensing of the driving transistor DT, which may be performed during the blank period in the display device according to an example embodiment of the present disclosure, may be performed in an initialization step, a tracking step, and a sampling step.

During the initialization step, the switching transistor SWT may be turned on, and the first node N1 (i.e., the gate electrode) of the driving transistor DT may be initialized to a sensing data voltage Vdata for mobility sensing, by the scan signal SCAN at a turn-on level.

Further, the sensing transistor SET and the sensing reference switch SPRE may be turned on, by a sensing signal SENSE at a turn-on level. In this state, the second node N2 (e.g., the source electrode) of the driving transistor DT may be initialized to the sensing reference voltage VpreS.

The tracking step may be a step of tracking a mobility of the driving transistor DT. The mobility of the driving transistor DT may represent a current driving capability of the driving transistor DT. A voltage at the second node N2 of the driving transistor DT representing a mobility of the driving transistor DT may be tracked by the tracking step.

During the tracking step, the switching transistor SWT may be turned off, and the sensing reference switch SPRE may be shifted to a turn-off level, by a scan signal SCAN at a turn-off level. By doing this, both the first node N1 and the second node N2 of the driving transistor DT may be floated so that the voltages at both the first node N1 and the second node N2 of the driving transistor DT may rise. Specifically, the voltage at the second node N2 of the driving transistor DT may be initialized to a sensing reference voltage VpreS to start to rise from the sensing reference voltage VpreS. At this time, the sensing transistor SET may be turned on so that the rise in the voltage at the second node N2 of the driving transistor DT may lead to the rise of a second sensing voltage on the reference voltage line RVL.

During the sampling step, the sampling switch SAM may be turned on when a predetermined time $\Delta t$ elapses from the time when the voltage at the second node N2 of the driving transistor DT starts to rise. At this time, the ADC 131 may sense the second sensing voltage on the reference voltage line RVL connected by the sampling switch SAM and may convert the second sensing voltage, which is an analog signal, into second sensing data, which is a digital signal. Here, the second sensing voltage applied to the ADC 131 may correspond to a level (VpreS+$\Delta$V) raised by a predetermined voltage $\Delta$V from the sensing reference voltage VpreS.

Here, the mobility of the driving transistor DT may be proportional to a voltage variance per unit time ($\Delta V/\Delta t$) of the reference voltage line RVL in the tracking step, in other words, a slope of a voltage waveform of the reference voltage line RVL.

That is, during the blank period, when the sensing reference switch SPRE (i.e., a first voltage switch) is in an off state, the reference switch SPRE for image driving (i.e., a second voltage switch) is switched from the on-state to an off-state, and the sampling switch SAM is in an on state, the second sensing voltage may be sampled.

In the meantime, as described above, when the sensing process is performed during the blank period, the pixel (PX) line or lines in which the sensing process is performed may be randomly selected.

Figure 7:
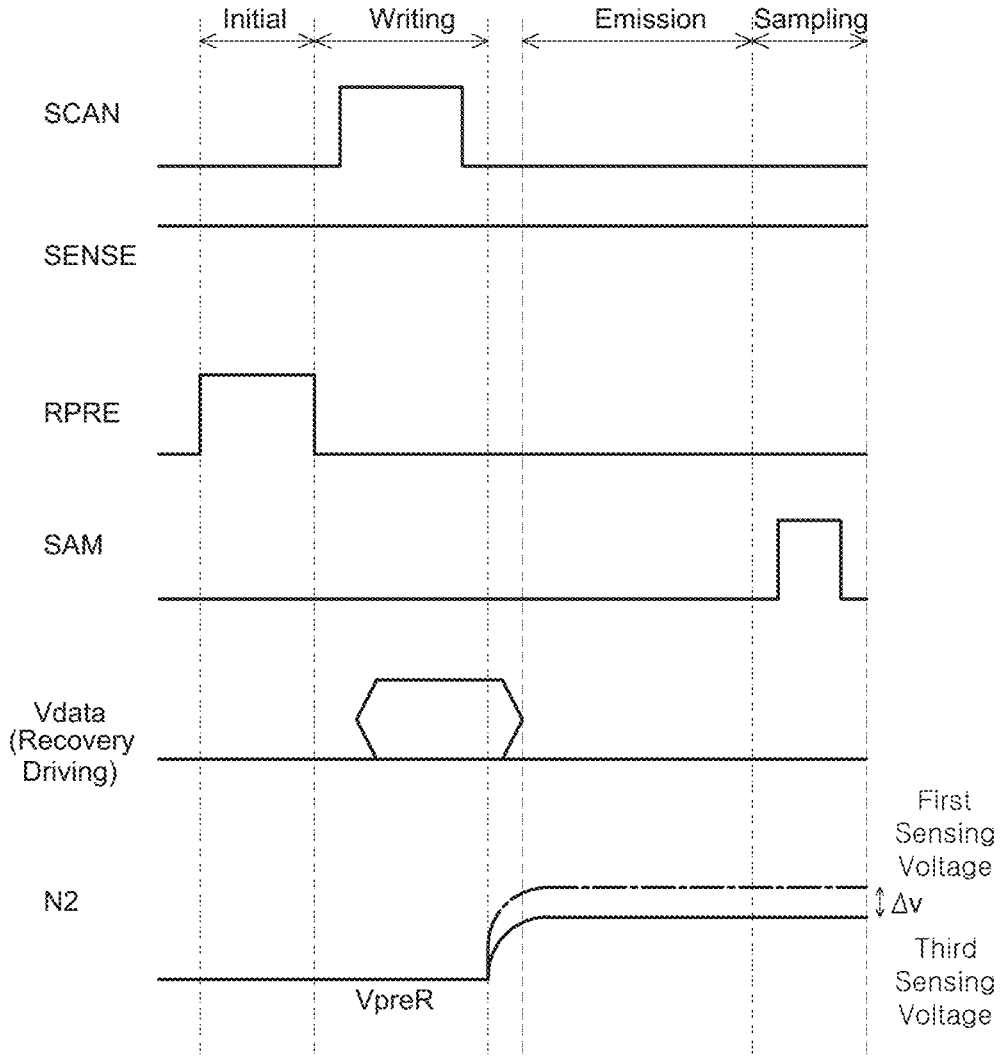
FIG. 7 is a timing chart of a signal for normal driving during a second driving period of a display device according to an example embodiment of the present disclosure.

FIG. 7 is a timing chart of a signal for normal driving during a second driving period of a display device according to an example embodiment of the present disclosure.

As shown in FIGS. 2, 3, and 7, in the display device according to an example embodiment of the present disclosure, during the second driving period, an initialization step, a writing step, an emission step, and a sampling step may be performed.

During the initialization step, the sensing transistor SET may be turned on, and the driving reference switch RPRE may be turned on, by a sensing signal SENSE at a turn-on level. In this state, the second node N2 (e.g., the source electrode) of the driving transistor DT may be initialized to a driving reference voltage VpreR.

During the writing step, the switching transistor SWT may be turned on, and a second image data voltage Vdata for recovery driving may be written in the first node N1 (i.e., the gate electrode) of the driving transistor DT, by the scan signal SCAN at a turn-on level.

During the emission step, a voltage corresponding to a difference between the second image data voltage Vdata (recovery driving) and the threshold voltage may be charged at the second node N2 according to the second image data voltage Vdata (recovery driving) written in the first node N1. Further, a driving current flowing in the light emitting diode 150 may be determined according to the voltage at the second node N2 so that the light emitting diode 150 may emit light.

During the sampling step, the sampling switch SAM may be turned on. At this time, the ADC 131 may sense a third sensing voltage on the reference voltage line RVL connected by the sampling switch SAM and may convert the third sensing voltage, which is an analog signal, into third sensing data, which is a digital signal. Here, the third sensing voltage applied to the ADC 131 may be a voltage at the second node N2 which is saturated during the second driving period.

The third sensing voltage represented by a solid line may not be equal to the first sensing voltage represented by a dotted line. For example, the third sensing voltage may be relatively lower than the first sensing voltage.

Specifically, during the first driving period and the second driving period, the degree of RC delay may vary according to the driving condition (e.g., a gray-scale condition and a frequency condition) of the display panel 110. Therefore, the third sensing voltage sampled during the second driving period may be lower than the first sensing voltage sampled during the first driving period.

That is, during the second driving period, when the reference switch RPRE for image driving (i.e., a second voltage switch) is in an off state, the reference switch SPRE for sensing (i.e., a first voltage switch) is switched from the on-state to an off-state, and the sampling switch SAM is in an on state, the third sensing voltage may be sampled.

Figure 8:
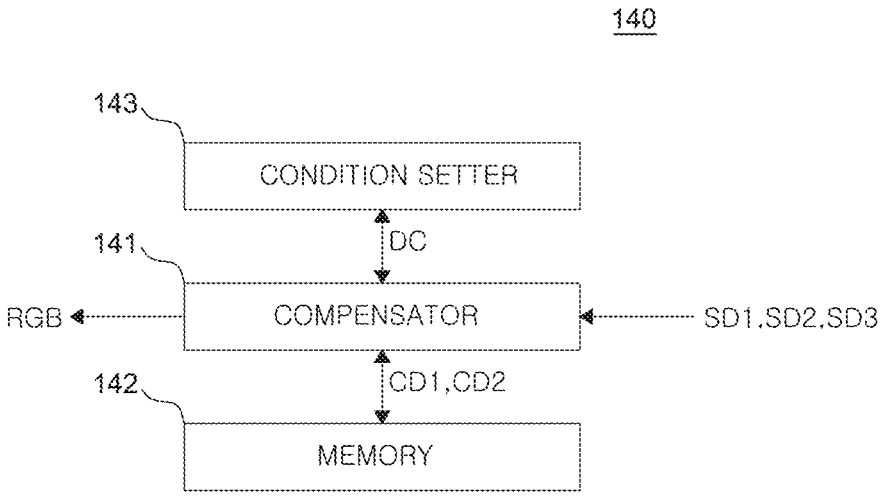
FIG. 8 is a block diagram of a timing controller of a display device according to an example embodiment of the present disclosure.

FIG. 8 is a block diagram of a timing controller of a display device according to an example embodiment of the present disclosure.

Hereinafter, an operation of a timing controller of a display device according to an example embodiment of the present disclosure will be specifically described.

The data compensator 141 may compensate for image data RGB based on a sensing data SD output from the ADC 131.

Specifically, the data compensator 141 may compare the first sensing data SD1 and the third sensing data SD3 to calculate first compensation data CD1 reflecting a difference between the sensing voltages in the first driving period and the second driving period.

Therefore, the data compensator 141 may compare the first sensing data SD1 and the third sensing data SD3 to determine the difference of the data voltages Vdata before and after the blank period. Further, the first compensation data CD1 reflecting an offset of the data voltage Vdata may be calculated. The first compensation data CD1 may be stored in the memory 142.

The data compensator 141 may compare the second sensing data SD2 to calculate second compensation data CD2 reflecting a mobility of the driving transistor.

The data compensator 141 may determine the mobility of the driving transistor DT in the corresponding pixel PX by means of the second sensing data SD2. Further, the data compensator 141 may compare the reference data stored in the memory 142 and the second sensing data SD2 to calculate the second compensation data CD2 reflecting a deviation in the mobility of the driving transistor DT. The second compensation data CD2 may be stored in the memory 142.

The data compensator 141 may use the first compensation data CD1 and the second compensation data CD2 stored in the memory 142 to compensate for image data RGB.

Specifically, when the image data RGB is compensated, it means that a first gain according to the first compensation data CD1 and a second gain according to the second compensation data CD2 are applied to the input image data RGB to determine the compensated image data RGB.

In the meantime, as shown in FIG. 8, the condition setter 143 may set a driving condition of the plurality of pixels PX. That is, the condition setter 143 may set the data driver to output a plurality of data voltages Vdata in accordance with all driving conditions.

The all driving conditions may refer to one or more of a driving frequency, a driving gray scale, and a driving color. For example, the condition setter 143 may set driving condition information to allow the data driver to output a first image data voltage and a second image data voltage in accordance with each of 60 Hz, 120 Hz, and 240 Hz. Further, the condition setter 143 may set driving condition information to allow the data driver to output a first image data voltage and a second image data voltage in accordance with each of a plurality of gray scales (0 gray to 255 gray). Therefore, the data compensator 141 may calculate the first compensation data CD1 and the second compensation data CD2 for each of all the driving conditions.

Accordingly, the display device according to an example embodiment of the present disclosure not only may compensate for a characteristic value of the driving transistor according to the second compensation data CD2, but also may compensate for the difference of the data voltages Vdata before and after the blank period according to the first compensation data CD1, for each of all the driving conditions. Accordingly, in the display device according to an example embodiment of the present disclosure, the displayed images before and after the blank time in which the sensing is performed may be the same. Accordingly, the display device according to an example embodiment of the present disclosure may suppress the deterioration of the image quality caused by the sensing.

In the meantime, the display device according to an example embodiment of the present disclosure may perform the sensing process for all driving conditions so that the process time may be extended. Therefore, the above-described sensing process may be performed after turning off the power of the display device.

Hereinafter, a driving method of a display device according to an example embodiment of the present disclosure will be described with reference to FIG. 9. The driving method of a display device according to an example embodiment of the present disclosure will be described based on the premise of the above-described display device according to an example embodiment of the present disclosure. Therefore, FIGS. 1 to 8 and the reference numerals denoted therein will be adopted in the below description as they are.

Figure 9:
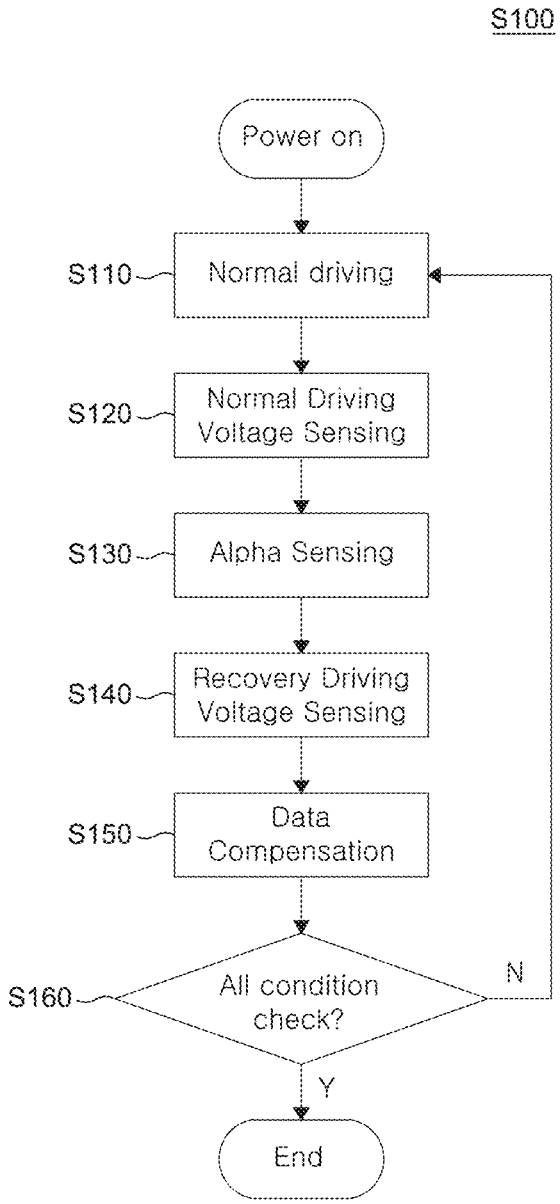
FIG. 9 is a flowchart for explaining a driving method of a display device according to an example embodiment of the present disclosure.

FIG. 9 is a flowchart for explaining a driving method of a display device according to an example embodiment of the present disclosure.

As illustrated in FIG. 9, the driving method S100 of a display device according to an example embodiment of the present disclosure may include a normal driving step S110, a first sensing step (normal driving voltage sensing) S120, a second sensing step (alpha sensing) S130, a third sensing step (recovery driving voltage sensing) S140, a data compensation step S150, and a condition setting step (all condition check) S160.

In the normal driving step S110, a data voltage Vdata for normal driving may be sequentially written in the pixels PX in the plurality of lines so that the plurality of pixels PX may emit light. Specifically, as shown in FIG. 5, in the display device according to an example embodiment of the present disclosure, during the first driving period, the plurality of pixels PX may emit light by the initialization step, the writing step, and the emission step.

In the first sensing step S120, the plurality of pixels PX may be sensed during the first driving period. As shown in FIG. 5, in the first sensing step S120, during the first driving period, when the sampling switch SAM is turned on, the ADC 131 may sense the first sensing voltage on the reference voltage line RVL connected by the sampling switch SAM and may convert the first sensing voltage, which is an analog signal, into first sensing data, which is a digital signal.

In the second sensing step S130, the plurality of pixels PX may be sensed during the blank period. As shown in FIG. 6, in the second sensing step S130, during the blank period, when the sampling switch SAM is turned on, the ADC 131 may sense the second sensing voltage on the reference voltage line RVL connected by the sampling switch SAM and may convert the second sensing voltage, which is an analog signal, into second sensing data, which is a digital signal.

In the third sensing step S140, the plurality of pixels PX may be sensed during the second driving period. As shown in FIG. 7, in the third sensing step S140, during the second driving period, when the sampling switch SAM is turned on, the ADC 131 may sense the third sensing voltage on the reference voltage line RVL connected by the sampling switch SAM and may convert the third sensing voltage, which is an analog signal, into third sensing data, which is a digital signal.

In the data compensation step S150, the data voltage may be compensated based on the first to the third sensing data.

As shown in FIGS. 8 and 9, in the data compensation step S150, the first sensing data SD1 and the third sensing data SD3 may be compared with each other to calculate first compensation data CD1 reflecting a difference between the sensing voltages in the first driving period and the second driving period. Specifically, in the data compensation step S150, the first sensing data SD1 and the third sensing data SD3 may be compared with each other to find out the difference of the data voltages Vdata before and after the blank period. Further, the first compensation data CD1 reflecting an offset of the data voltage Vdata may be calculated.

As shown in FIGS. 8 and 9, in the data compensation step S150, the second sensing data SD may be compared with a reference data stored in the memory 142 to calculate second compensation data CD2 reflecting a mobility of the driving transistor. Specifically, in the data compensating step S150, the mobility of the driving transistor DT in the corresponding pixel PX may be determined by means of the second sensing data SD2. Further, the reference data stored in the memory 142 and the second sensing data SD2 are compared to calculate second compensation data CD2 reflecting a deviation in the mobility of the driving transistor DT.

In the data compensation step S150, image data RGB may be compensated based on the first compensation data CD1 and the second compensation data CD2. Specifically, when the image data RGB is compensated, it means that a first gain according to the first compensation data CD1 and a second gain according to the second compensation data CD2 are applied to the input image data RGB to determine a compensated image data RGB. Therefore, in the data compensation step S150, the first compensation data CD1 and the second compensation data CD2 may be reflected in the output data voltage.

In the condition setting step S160, a plurality of data voltages Vdata may be output in accordance with all driving conditions.

Specifically, the data driver may output the first image data voltage and the second image data voltage in accordance with each of 60 Hz, 120 Hz, and 240 Hz, or the data driver may output the first image data voltage and the second image data voltage in accordance with each of a plurality of gray scales (0 gray to 255 gray).

Therefore, in the condition setting step S160, when the plurality of data voltages Vdata is output in accordance with all the driving conditions, the compensation process ends. Otherwise, the procedure returns to the normal driving step S110 to repeat the compensation process until is the pixels are driven under all driving conditions.

Accordingly, in the driving method of the display device according to an example embodiment of the present disclosure, not only a deviation in a characteristic value of the driving transistor may be compensated for according to the second compensation data CD2, but also the difference of the data voltages Vdata before and after the blank period may be compensated for according to the first compensation data CD1, for each of all the driving conditions. Accordingly, the displayed images before and after the blank period in which the sensing is performed may be maintained to be the same by the driving method of the display device according to an example embodiment of the present disclosure.

Example embodiments of the present disclosure can also be described as follows:

A display device according to an example embodiment of the present disclosure may comprise: a display panel including a plurality of pixels, the display panel being configured to be driven in a first driving period, a blank period after the first driving period, and a second driving period after the blank period; a data driver configured to provide a data voltage to at least one of the pixels to display an image based on a compensated image data, and detect a sensing voltage from a reference voltage line connected to the at least one of the pixels to convert the sensing voltage into a sensing data during the first driving period and the second driving period; and a timing controller configured to determine a first compensation data based on a difference between the sensing data detected during the first driving period and the sensing data detected during the second driving period, and determine the compensated image data based on an input image data and the first compensation data.

In some embodiments of the present disclosure, during the first driving period, the data driver may be configured to apply a first image data voltage to the at least one of the pixels and to detect a first sensing voltage on the reference voltage line. During the blank period, the data driver may be configured to apply a sensing data voltage to the at least one of the pixels and to detect a second sensing voltage on the reference voltage line. During the second driving period, the data driver may be configured to apply a second image data voltage to the at least one of the pixels and to detect a third sensing voltage on the reference voltage line.

In some embodiments of the present disclosure, the first image data voltage may be equal to the second image data voltage.

In some embodiments of the present disclosure, the data driver may include: an analog-to-digital converter configured to convert the sensing voltage into the sensing data; a digital-to-analog converter configured to convert the compensated image data into the data voltage; and a plurality of switches connected to the reference voltage line.

In some embodiments of the present disclosure, the plurality of switches may include: a first voltage switch configured to apply a driving reference voltage to the reference voltage line; a second voltage switch configured to apply a sensing reference voltage to the reference voltage line; and a sampling switch configured to connect the reference voltage line and the analog-to-digital converter.

In some embodiments of the present disclosure, during the first driving period: the second voltage switch may be configured to be in an off state; and the analog-to-digital converter may be configured to sample a first sensing voltage to determine a first sensing data with the sampling switch in an on-state after the first voltage switch being switched from an on state to an off state.

In some embodiments of the present disclosure, during the blank period: the first voltage switch may be configured to be in the off state; and the analog-to-digital converter may be configured to sample a second sensing voltage to determine a second sensing data with the sampling switch in the on state after the second voltage switch being switched from an on state to the off state.

In some embodiments of the present disclosure, during the second driving period: the second voltage switch is configured to be in the off state; and the analog-to-digital converter is configured to sample a third sensing voltage to determine a third sensing data with the sampling switch in an on-state after the first voltage switch being switched from the on state to the off state.

In some embodiments of the present disclosure, the timing controller may be further configured to determine the first compensation data based on a difference between the first sensing data and the third sensing data and to determine the compensated image data based on the first compensation data.

In some embodiments of the present disclosure, the timing controller may be further configured to determine the second compensation data based on the second sensing data and to determine the compensation image data based on the first compensation data and the second compensation data.

In some embodiments of the present disclosure, the timing controller may include: a data compensator configured to determine the first compensation data and to determine the compensated image data based on the first compensation data; and a memory configured to store the sensing data and the first compensation data.

In some embodiments of the present disclosure, the data compensator may be configured to compare the sensing data detected during the first driving period and the sensing data detected during the second driving period to determine the first compensation data.

In some embodiments of the present disclosure, during the blank period, the data driver may be configured to apply a sensing data voltage to the at least one of the pixels and to detect a second sensing data on the reference voltage line, and the data compensator may be further configured to: determine a second compensation data based on the second sensing data, the second compensation data reflecting a deviation in a mobility of a driving transistor of the at least one of the pixels; and determine the compensated image data based on the first compensation data and the second compensation data.

In some embodiments of the present disclosure, the timing controller may further include a condition setter configured to set a driving condition of the at least one of the pixels.

In some embodiments of the present disclosure, the condition setter may be configured to set the data driver to output the data voltage to the at least one of the pixels based on each of a plurality of driving frequencies and based on each of a plurality of gray scales.

According to an example embodiment of the present disclosure, a method of driving a display device, comprising a display panel including a plurality of pixels and a data driver configured to provide a data voltage to at least one of the pixels, the display panel being configured to be driven in a first driving period and a second driving period to display an image and in a blank period between the first driving period and the second driving period, may comprise: detecting a first sensing voltage on a reference voltage line connected to the at least one of the pixels and determining the first sensing data based on the first sensing voltage during the first driving period; detecting a second sensing voltage on the reference voltage line and determining the second sensing data based on the second sensing voltage during the blank period; detecting a third sensing voltage on the reference voltage line and determining the third sensing data based on the third sensing voltage during the second driving period; determining a compensated image data based on at least one of the first, second, and third sensing data; and applying the data voltage to the at least one of the pixels based on the compensated image data.

In some embodiments of the present disclosure, the determining of the compensated image data may include: determining a first compensation data based on a difference between the first sensing data and the second sensing data; and determining the compensated image data based on the first compensation data.

In some embodiments of the present disclosure, the determining of the compensated image data may include: determining a first compensation data based on a difference between the first sensing data and the second sensing data; determining a second compensation data based on the second sensing data, the second compensation data reflecting a deviation of a mobility of a driving transistor disposed in the at least one of the pixels; and determining the compensated image data based on the first compensation data and the second compensation data.

In some embodiments of the present disclosure, the determining of the first sensing data may include sampling the first sensing voltage to convert the first sensing voltage to the first sensing data. The determining of the second sensing data may include sampling the second sensing voltage to convert the second sensing voltage to the second sensing data. The determining of the third sensing data may include sampling the third sensing voltage to convert the third sensing voltage to the third sensing data.

In some embodiments of the present disclosure, the method may further comprise setting the data driver to apply the data voltage to the at least one of the pixels based on each of a plurality of driving frequencies and based on each of a plurality of gray scales.

Although example embodiments of the present disclosure have been described in detail with reference to the accompanying drawings, the present disclosure is not limited thereto and may be embodied in many different forms without departing from the technical concept of the present disclosure. Therefore, example embodiments of the present disclosure are provided for illustrative purposes only and are not intended to limit the technical concept of the present disclosure. The scope of the technical concept of the present disclosure is not limited thereto. Therefore, it should be understood that the above-described example embodiments are illustrative in all aspects and do not limit the present disclosure. The protective scope of the present disclosure should be construed based on the following claims, and all the technical concepts in the equivalent scope thereof should be construed as falling within the scope of the present disclosure.

It will be apparent to those skilled in the art that various modifications and variations can be made in the present disclosure without departing from the technical idea or scope of the disclosures. Thus, it is intended that embodiments of the present disclosure cover the modifications and variations of the disclosure provided they come within the scope of the appended claims and their equivalents.

What is claimed is:

1. A display device, comprising:

a display panel including a plurality of pixels, the display panel being configured to be driven in a first driving period, a blank period after the first driving period, and a second driving period after the blank period;

a data driver configured to:

provide a data voltage to at least one of the pixels to display an image based on a compensated image data; and detect a sensing voltage from a reference voltage line connected to the at least one of the pixels to convert the sensing voltage into a sensing data during the first driving period and the second driving period; and a timing controller configured to:

determine a first compensation data based on a difference between the sensing data detected during the first driving period and the sensing data detected during the second driving period; and determine the compensated image data based on an input image data and the first compensation data.

2. The display device of claim 1, wherein:

during the first driving period, the data driver is configured to apply a first image data voltage to the at least one of the pixels and to detect a first sensing voltage on the reference voltage line, during the blank period, the data driver is configured to apply a sensing data voltage to the at least one of the pixels and to detect a second sensing voltage on the reference voltage line, and during the second driving period, the data driver is configured to apply a second image data voltage to the at least one of the pixels and to detect a third sensing voltage on the reference voltage line.

3. The display device of claim 2, wherein the first image data voltage is equal to the second image data voltage.

4. The display device of claim 1, wherein the data driver includes:

an analog-to-digital converter configured to convert the sensing voltage into the sensing data;

a digital-to-analog converter configured to convert the compensated image data into the data voltage; and a plurality of switches connected to the reference voltage line.

5. The display device of claim 4, wherein the plurality of switches includes:

a first voltage switch configured to apply a driving reference voltage to the reference voltage line;

a second voltage switch configured to apply a sensing reference voltage to the reference voltage line; and a sampling switch configured to connect the reference voltage line and the analog-to-digital converter.

6. The display device of claim 5, wherein, during the first driving period:

the second voltage switch is configured to be in an off state; and the analog-to-digital converter is configured to sample a first sensing voltage to determine a first sensing data with the sampling switch in an on-state after the first voltage switch being switched from an on state to an off state.

7. The display device of claim 6, wherein, during the blank period:

the first voltage switch is configured to be in the off state; and the analog-to-digital converter is configured to sample a second sensing voltage to determine a second sensing data with the sampling switch in the on state after the second voltage switch being switched from an on state to the off state.

8. The display device of claim 7, wherein, during the second driving period:

the second voltage switch is configured to be in the off state; and the analog-to-digital converter is configured to sample a third sensing voltage to determine a third sensing data with the sampling switch in an on-state after the first voltage switch being switched from the on state to the off state.

9. The display device of claim 8, wherein the timing controller is further configured to determine the first compensation data based on a difference between the first sensing data and the third sensing data and to determine the compensated image data based on the first compensation data.

10. The display device of claim 9, wherein the timing controller is further configured to determine the second compensation data based on the second sensing data and to determine the compensation image data based on the first compensation data and the second compensation data.

11. The display device of claim 1, wherein the timing controller includes:

a data compensator configured to determine the first compensation data and to determine the compensated image data based on the first compensation data; and a memory configured to store the sensing data and the first compensation data.

12. The display device of claim 11, wherein the data compensator is configured to compare the sensing data detected during the first driving period and the sensing data detected during the second driving period to determine the first compensation data.

13. The display device of claim 11, wherein:

during the blank period, the data driver is configured to apply a sensing data voltage to the at least one of the pixels and to detect a second sensing data on the reference voltage line, and the data compensator is further configured to:

determine a second compensation data based on the second sensing data, the second compensation data reflecting a deviation in a mobility of a driving transistor of the at least one of the pixels; and determine the compensated image data based on the first compensation data and the second compensation data.

14. The display device of claim 1, wherein the timing controller further includes a condition setter configured to set a driving condition of the at least one of the pixels.

15. The display device of claim 14, wherein the condition setter is configured to set the data driver to output the data voltage to the at least one of the pixels based on each of a plurality of driving frequencies and based on each of a plurality of gray scales.

16. A method of driving a display device comprising a display panel including a plurality of pixels and a data driver configured to provide a data voltage to at least one of the pixels, the display panel being configured to be driven in a first driving period and a second driving period to display an image and in a blank period between the first driving period and the second driving period, the method comprising:

detecting a first sensing voltage on a reference voltage line connected to the at least one of the pixels and determining the first sensing data based on the first sensing voltage during the first driving period;

detecting a second sensing voltage on the reference voltage line and determining the second sensing data based on the second sensing voltage during the blank period;

detecting a third sensing voltage on the reference voltage line and determining the third sensing data based on the third sensing voltage during the second driving period;

determining a compensated image data based on at least one of the first, second, and third sensing data; and applying the data voltage to the at least one of the pixels based on the compensated image data.

17. The method of claim 16, wherein the determining of the compensated image data includes:

determining a first compensation data based on a difference between the first sensing data and the second sensing data; and determining the compensated image data based on the first compensation data.

18. The method of claim 16, wherein the determining of the compensated image data includes:

determining a first compensation data based on a difference between the first sensing data and the second sensing data;

determining a second compensation data based on the second sensing data, the second compensation data reflecting a deviation of a mobility of a driving transistor disposed in the at least one of the pixels; and determining the compensated image data based on the first compensation data and the second compensation data.

19. The method of claim 16, wherein:

the determining of the first sensing data includes sampling the first sensing voltage to convert the first sensing voltage to the first sensing data;

the determining of the second sensing data includes sampling the second sensing voltage to convert the second sensing voltage to the second sensing data; and the determining of the third sensing data includes sampling the third sensing voltage to convert the third sensing voltage to the third sensing data.

20. The method of claim 16, further comprising:

setting the data driver to apply the data voltage to the at least one of the pixels based on each of a plurality of driving frequencies and based on each of a plurality of gray scales.

* * * * *